US006769783B2

(12) United States Patent
Huang

(10) Patent No.: US 6,769,783 B2
(45) Date of Patent: Aug. 3, 2004

(54) VISUAL ANGLE-DEPENDENT IMAGING DEVICE

(76) Inventor: Kuo-Pao Huang, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 10/270,427

(22) Filed: Oct. 15, 2002

(65) Prior Publication Data

US 2004/0070972 A1 Apr. 15, 2004

(51) Int. Cl.[7] ..... A47F 11/10
(52) U.S. Cl. ..... 362/125; 362/154; 40/600
(58) Field of Search ..... 362/125, 128, 362/133, 154; 428/542.2; 359/1, 8, 18, 20, 28; 40/800, 540

(56) References Cited

U.S. PATENT DOCUMENTS 2,334,750 A * 11/1943 Cerracchio ..... 434/365
6,241,362 B1 * 6/2001 Morrison ..... 362/231

* cited by examiner

*Primary Examiner*—John Anthony Ward

(57) ABSTRACT

A visual angle-dependent imaging device comprises a main body; a show window on a front side of the main body, a concave portion within the show window; an inner wall of the concave portion being installed with a three-dimensional concave sculpture with a specific pattern; a lamp seat at a bottom of the main body. The lamp seat is communicated with the concave portion of the main body. A light source is installed on the lamp seat for projecting light to the concave portion of the main body. When light emitted from the light source is projected to an inner surface of the concave portion, the light is reflected from different portions of the concave portion. When a viewer views the three-dimensional concave sculpture from different viewing angles of the show window, the three-dimensional concave sculpture will project to the eyes of the viewer with a different image dependent on the viewing angle of the viewer.

2 Claims, 7 Drawing Sheets

VISUAL ANGLE-DEPENDENT IMAGING DEVICE

BACKGROUND OF THE INVENTION

The present invention relates to imaging device, and particularly to a visual angle-dependent imaging device. By the present invention, when a viewer views a concave sculpture within the imaging device from different viewing angles, the sculpture will project to the eyes of the viewer with a different image dependent on the viewing angle of the viewer. Moreover, the light source may emit various colors.

In general, other than using colors to present a pattern, a pattern can be presented by a three-dimensional sculpture. Thereby, many decorations are made as a three-dimensional sculpture. Most of these decorations are made as a convex sculpture. When light emits upon this sculpture, an image with shading effect is presented to the viewer.

Moreover, some decorations are presented as a three-dimensional concave sculpture for presenting an image which is different from above mentioned three-dimensional convex sculpture. However, this prior art has no light source, and thus the image is dark so as to present a poor effect. Moreover, the three-dimensional concave sculpture is directly presented without being equipped with other decorating components so that the total image effect is not preferred even worse than a convex image.

SUMMARY OF THE INVENTION

Accordingly, the primary object of the present invention is to provide a visual angle-dependent imaging device comprises a main body; a show window on a front side of the main body, a concave portion within the show window; an inner wall of the concave portion being installed with a three-dimensional concave sculpture with a specific pattern; a lamp seat at a bottom of the main body. The lamp seat is communicated with the concave portion of the main body. A light source is installed on the lamp seat for projecting light to the concave portion of the main body. When light emitted from the light source is projected to an inner surface of the concave portion, the light is reflected from different portions of the concave portion. When a viewer views the three-dimensional concave sculpture from different viewing angles of the show window, the three-dimensional concave sculpture will project to the eyes of the viewer with a different image dependent on the viewing angle of the viewer. Another object of the present invention is to provide a visual angle-dependent imaging device, wherein the light source is formed by a plurality of LEDs with different colors.

The various objects and advantages of the present invention will be more readily understood from the following detailed description when read in conjunction with the appended drawing.

DETAILED DESCRIPTION OF THE PREFERRED EMBODIMENTS

Figure 1:
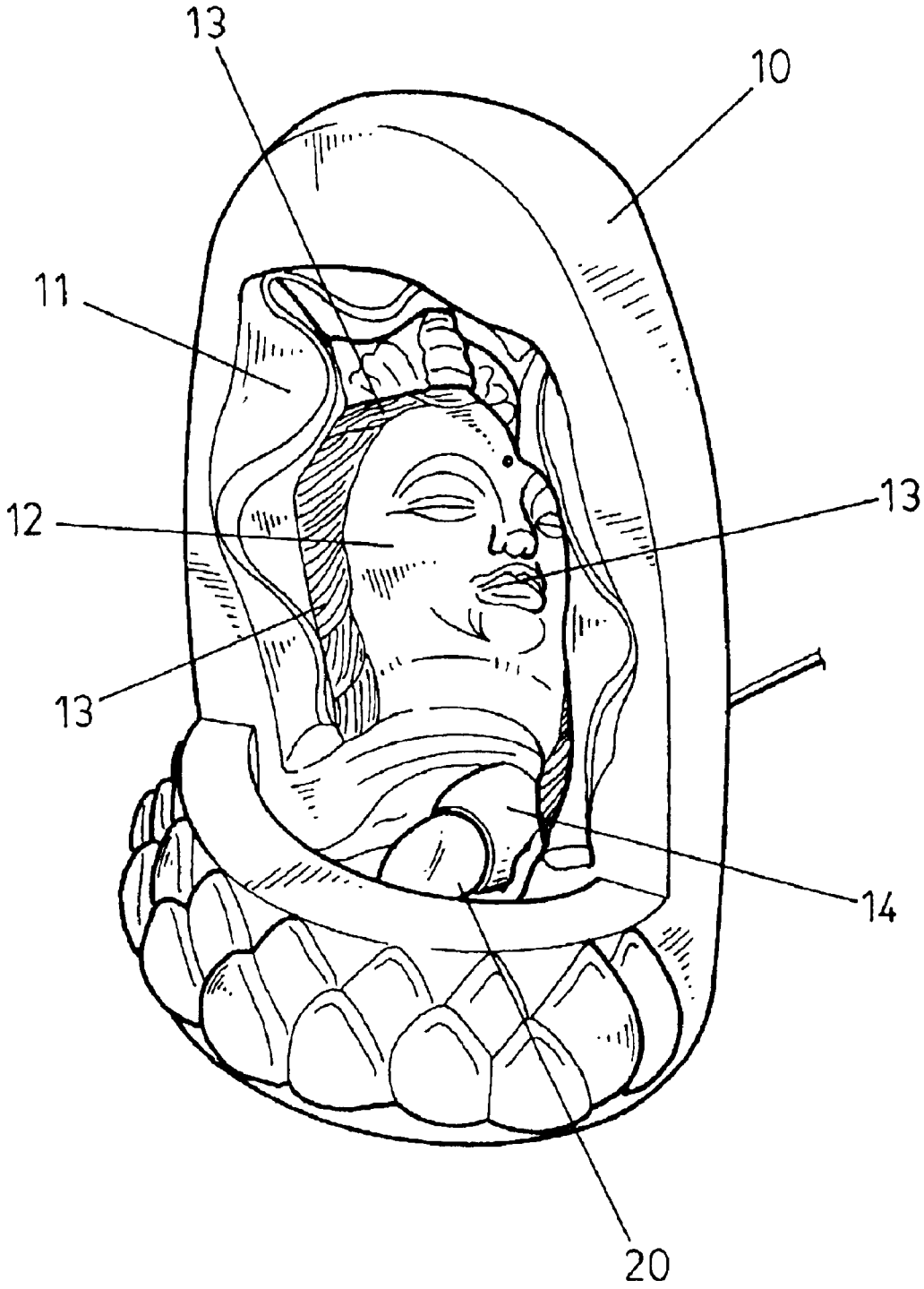
FIG. 1 is a perspective view of the present invention.
Figure 2:
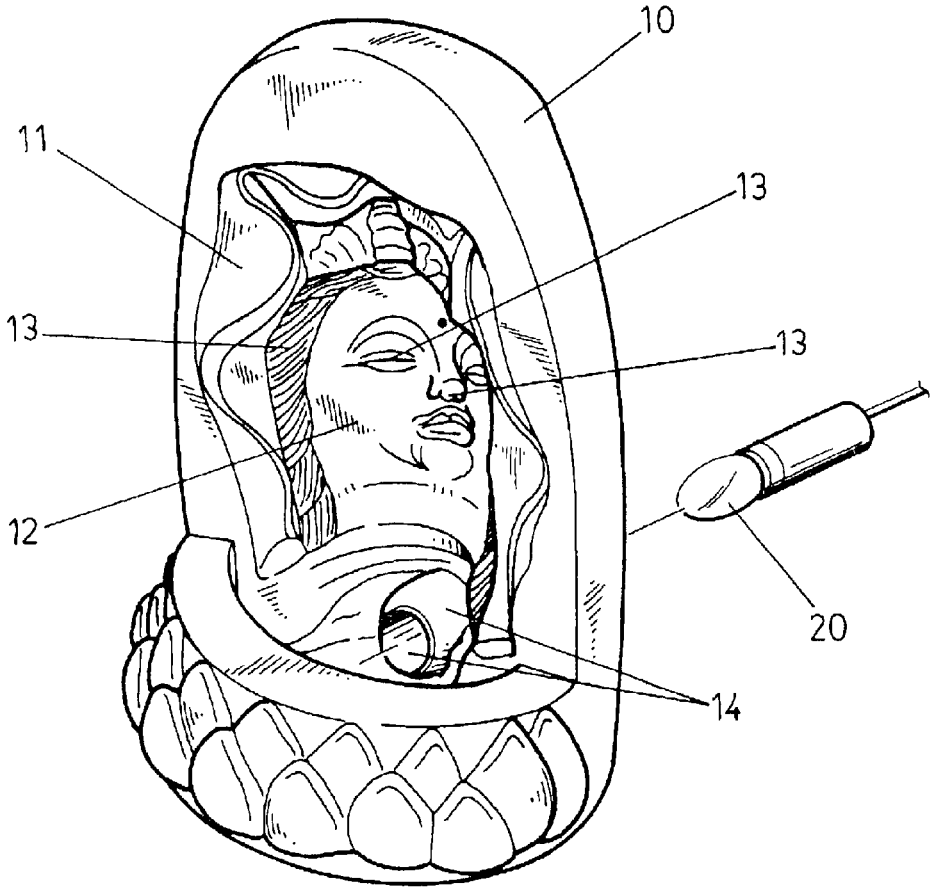
FIG. 2 is a structural exploded view of the present invention.
Figure 3:
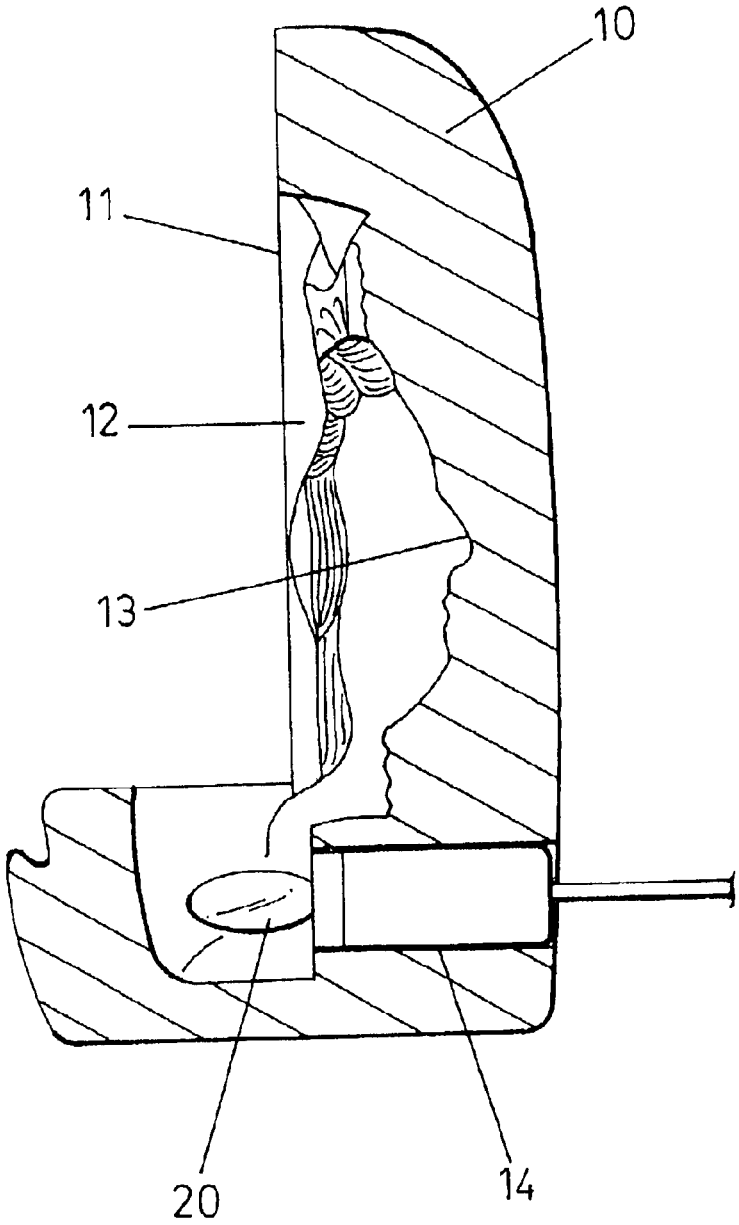
FIG. 3 is a structural cross sectional view of the present invention.

Referring to FIGS. 1 to 3, the visual angle-dependent imaging device of the present invention is illustrated. The visual angle-dependent imaging device includes a main body 10, a show window 11 on a front side of the main body 10, a concave portion 12 within the show window 11, and a lamp seat 14 at a bottom of the main body 10. The inner wall of the concave portion 12 is installed with a three-dimensional concave sculpture 13 with a specific pattern. The lamp seat 14 is communicated with the concave portion 12 of the main body 10.

Besides, the lamp seat 14 of the main body 10 is installed with a lamp seat 14. The light source 20 projects light to the concave portion 12 of the main body 10. Thereby, when light emitted from the light source 20 is projected to an inner surface of the concave portion 12; the light is reflected from different portions of the concave portion 12. When a viewer views the three-dimensional concave sculpture 13 from different viewing angles of the show window It. The three-dimensional concave sculpture 13 will project to the eyes to the viewer with a different image dependent on the viewing angle of the viewer. In this embodiment, the three-dimensional concave sculpture 13 is a head portion of a Buddhist image.

Figure 4:
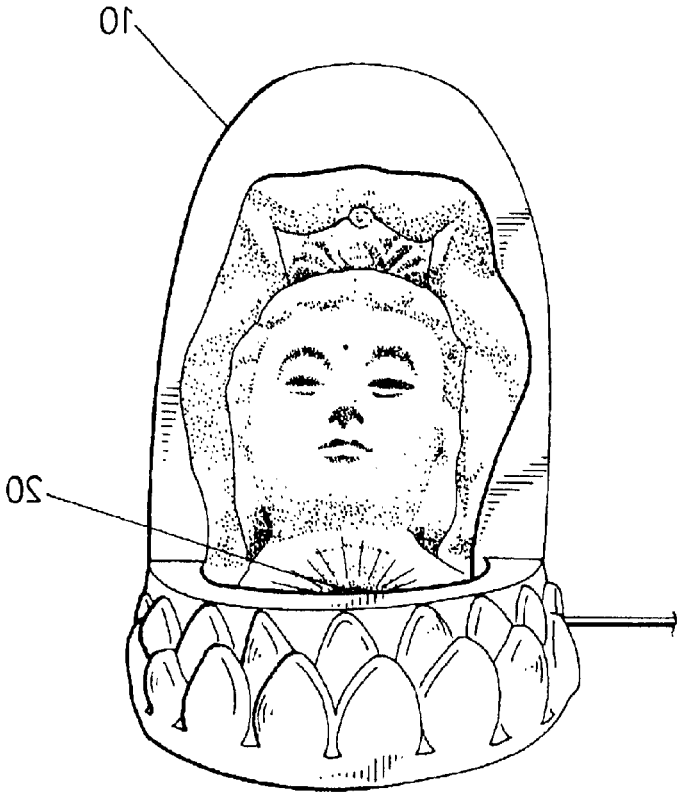
FIG. 4 shows one embodiment of the present invention showing a result, where the viewer views the present invention from a front side.
Figure 5:
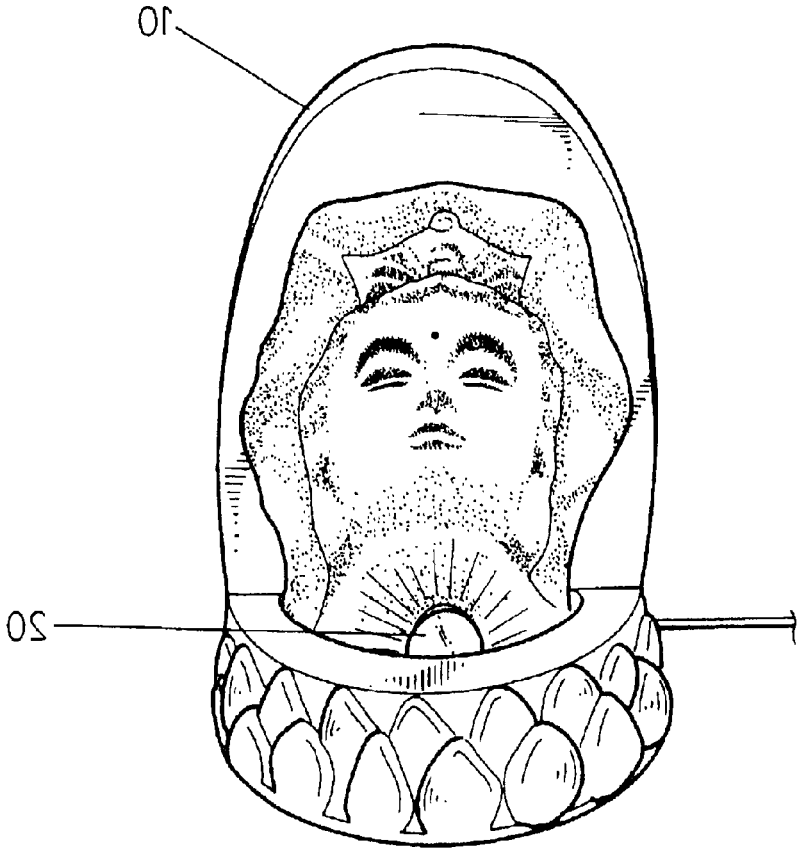
FIG. 5 shows one embodiment of the present invention showing a result, where the viewer views the present invention from an upper side.
Figure 6:
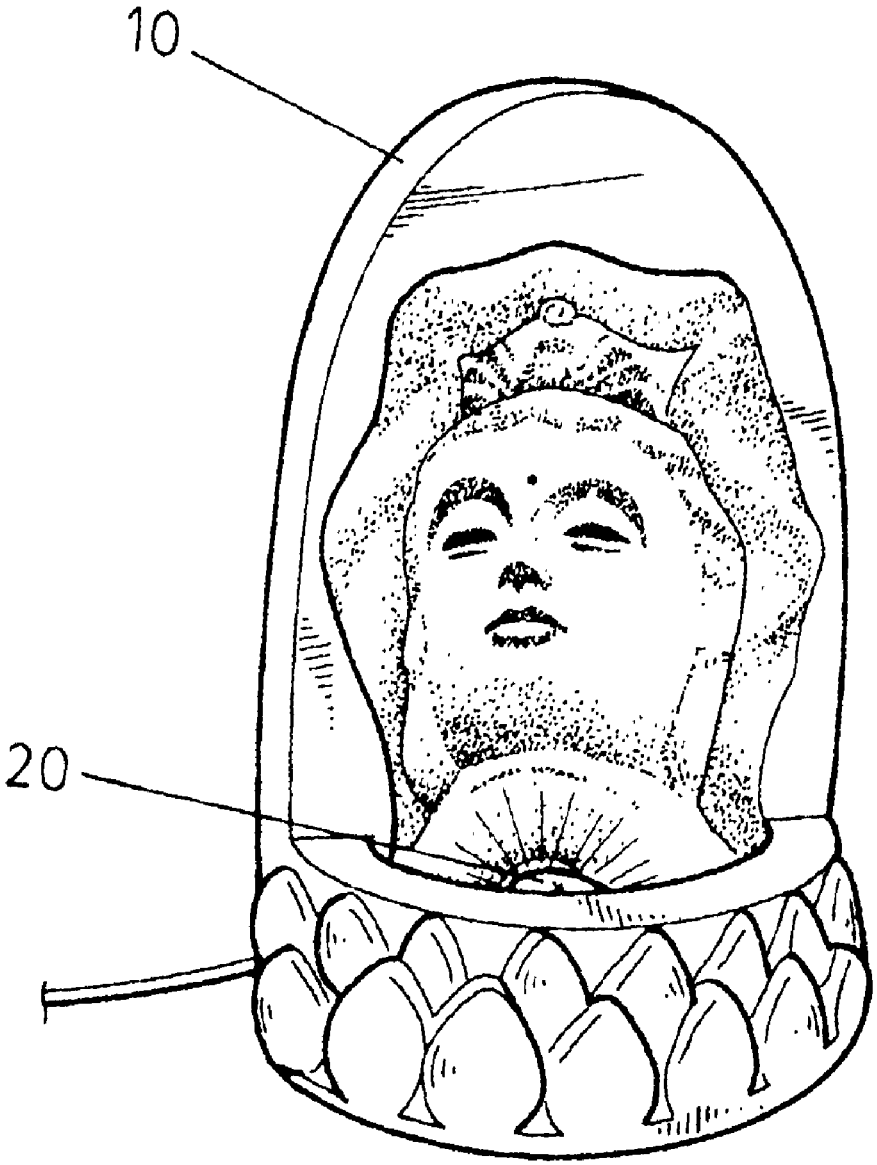
FIG. 6 shows one embodiment of the present invention showing a result, where the viewer views the present invention from the left side.
Figure 7:
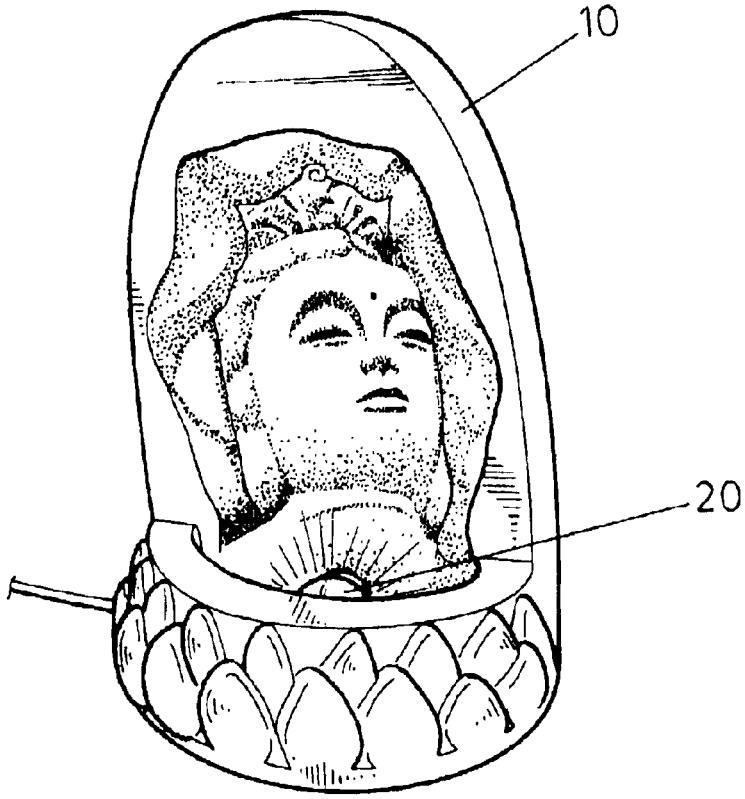
FIG. 7 shows one embodiment of the present invention showing a result, where the viewer views the present invention from the right side.

Referring to FIGS. 4 to 7, another embodiment of the present invention is illustrated. In this embodiment, the three-dimensional concave sculpture 13 is a Buddhist image. In FIG. 4, the viewer views the Buddhist image from the front surface of the show window 11. It is illustrated from FIG. 4 that the front image of the Buddhist image views the viewer Referring to FIG. 5, the viewer views the Buddhist image from an upper side. Then, it is shown that the reflected Buddhist image views upwards as the Buddhist image views the viewer. With reference to FIGS. 6 and 7, the viewer views the Buddhist image from the left and right sides, respectively. Then, it is shown that the Buddhist image turns leftwards and rightwards toward the viewer. Thus, in the present invention, the three-dimensional concave sculpture 13 is imaged with the viewing angle of the viewer.

In the present invention, the light source 20 may be LED lights. By different incident light, different reflecting light is presented so that the three-dimensional concave sculpture 13 presents various colors.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A visual angle-dependent imaging device comprising:

a main body having a show window on a front side of the main body, a concave portion being within the show window; an inner wall of the concave portion being installed with a three-dimensional concave sculpture;

a lamp seat at a bottom of the main body; the lamp seat being communicated with the concave portion of the main body;

a light source installed on the lamp seat for projecting light to the concave portion of the main body;

wherein when light emitted from the light source is projected to an inner surface of the concave portion, the light is reflected from different portions of the concave portion; when a viewer views the three-dimensional concave sculpture from different viewing angles of the show window, the three-dimensional concave sculpture will project to the of the viewer with a different image dependent on the viewing angle of the viewer.

2. The visual angle-dependent imaging device as claimed in claim 1, wherein the light source is formed by a plurality of LEDs of different colors.

* * * * *